US005236189A

United States Patent [19]

Ikoma

[11] Patent Number: 5,236,189

[45] Date of Patent: Aug. 17, 1993

[54] FINISHER FOR AN IMAGE FORMING APPARATUS

[75] Inventor: Tadashi Ikoma, Yokohama, Japan

[73] Assignee: Ricoh Company, Ltd., Tokyo, Japan

[21] Appl. No.: 890,010

[22] Filed: May 29, 1992

[30] Foreign Application Priority Data

May 30, 1991 [JP] Japan ..... 3-127782

[51] Int. Cl.[5] ..... B65H 39/11; B42B 2/00

[52] U.S. Cl. ..... 271/292; 271/293; 270/53; 355/323; 355/324

[58] Field of Search ..... 355/323, 324, 321; 271/287, 292, 293, 294; 270/53

[56] References Cited

U.S. PATENT DOCUMENTS

| | | | |
|---|---|---|---|
| 4,444,491 | 4/1984 | Rinehart et al. | 355/50 |
| 4,681,310 | 7/1987 | Cooper | 271/294 X |
| 4,880,223 | 11/1989 | Yamazaki et al. | 271/293 |
| 4,925,171 | 5/1990 | Kramer et al. | 271/293 X |
| 4,962,920 | 10/1990 | Kitajima | 271/293 |
| 4,965,629 | 10/1990 | Hiroi et al. | 355/324 X |
| 5,035,412 | 7/1991 | Hiroi et al. | 271/294 X |
| 5,048,820 | 9/1991 | Chung et al. | 271/293 |
| 5,088,710 | 2/1992 | Suzuki et al. | 271/293 X |
| 5,090,688 | 2/1992 | Sasaki | 271/293 |
| 5,098,074 | 3/1992 | Mandel et al. | 270/53 |
| 5,112,035 | 5/1992 | Yamamoto et al. | 271/293 X |

*Primary Examiner*—Richard L. Moses

*Attorney, Agent, or Firm*—Oblon, Spivak, McClelland, Maier & Neustadt

[57] ABSTRACT

A finisher incorporated in an image forming apparatus and capable of setting up a plurality of stapling or otherwise finishing positions in the widthwise direction of a paper sheet. A plurality of bins are each movable in a direction perpendicular to the direction in which it is moved up and down. After one bin has been moved in such a direction until the edge of a paper stack on the paper inlet side has been aligned with a stapling unit, the stapling unit is movable in a direction perpendicular to a paper discharge direction, i.e., in the widthwise direction to staple the paper stack at a plurality of positions.

6 Claims, 6 Drawing Sheets

FINISHER FOR AN IMAGE FORMING APPARATUS

BACKGROUND OF THE INVENTION

The present invention relates to an image forming apparatus and, more particularly, to a finisher incorporated in a copier for finishing copy sheets driven out of the copier.

It is a common practice with a copier or similar image forming apparatus to discharge a paper sheet carrying a document image toward a copy tray after the document image has been fixed on the sheet. The copier is operable with a finisher including a sorter for sorting copy sheets sequentially driven out of the copier to a plurality of bins, and a stapler for stapling the stacks of paper sheets loaded on the bins one after another. The sorter has been proposed in various forms as disclosed in, for example, Japanese Patent Laid-Open Publication Nos. 34855/1989 and 34864/1989 and U.S. Pat. No. 3,833,911. In this kind of sorter, a plurality of bins constitute copy trays for accommodating copy sheets sequentially discharged from the copier, and each has pins at opposite ends thereof in the widthwise direction of paper sheets. The pins of each bin are received in the grooves of helical cams to be movable up and down. As the helical cams are rotated, a required number of bins are sequentially brought to a position at which copy sheets driven out of the copier arrive. To guarantee the space for introducing paper sheets, the helical cams have their lead changed in the axial direction such that part thereof having a greater lead, i.e., spacing nearby bins by a greater distance faces a paper introducing mechanism. On the other hand, a jogger extends throughout the bins for positioning paper sheets sequentially discharged onto the bins. A stack of paper sheets neatly positioned by the jogger is stapled at one end in the widthwise direction thereof by the stapler which is located at one end in the widthwise direction of the bin.

The problem with the conventional sorter described above is that it can staple a paper stack only at a single position adjacent to one end of the paper stack with respect to the widthwise direction. Specifically, when a stack of paper sheets having a relatively great width are stapled only at a single position thereof, the resulting stack is apt to become loose when read or otherwise handled afterwards.

SUMMARY OF THE INVENTION

It is therefore an object of the present invention to provide a finisher for an image forming apparatus which is capable of stapling or otherwise finishing a stack of paper sheets at a plurality of positions in the widthwise direction of the paper sheets.

In accordance with the present invention, in a finisher in which a plurality of bins in the form of trays each has part of opposite ends thereof in a widthwise direction of a paper sheet engaged with grooves of rotatable helical screws and helical cams and each is moved in an up-and-down direction for sorting paper sheets, the bins each has an engaging portion at each of opposite ends thereof in the widthwise direction independently of the part engaged with the grooves of the helical screws and herical cams. An engaging and disengaging mechanism is connected to the engaging portions for moving the bin in a direction perpendicular to the up-and-down direction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Referring to FIGS. 1–7, a finisher embodying the present invention will be described.

Figure 1:
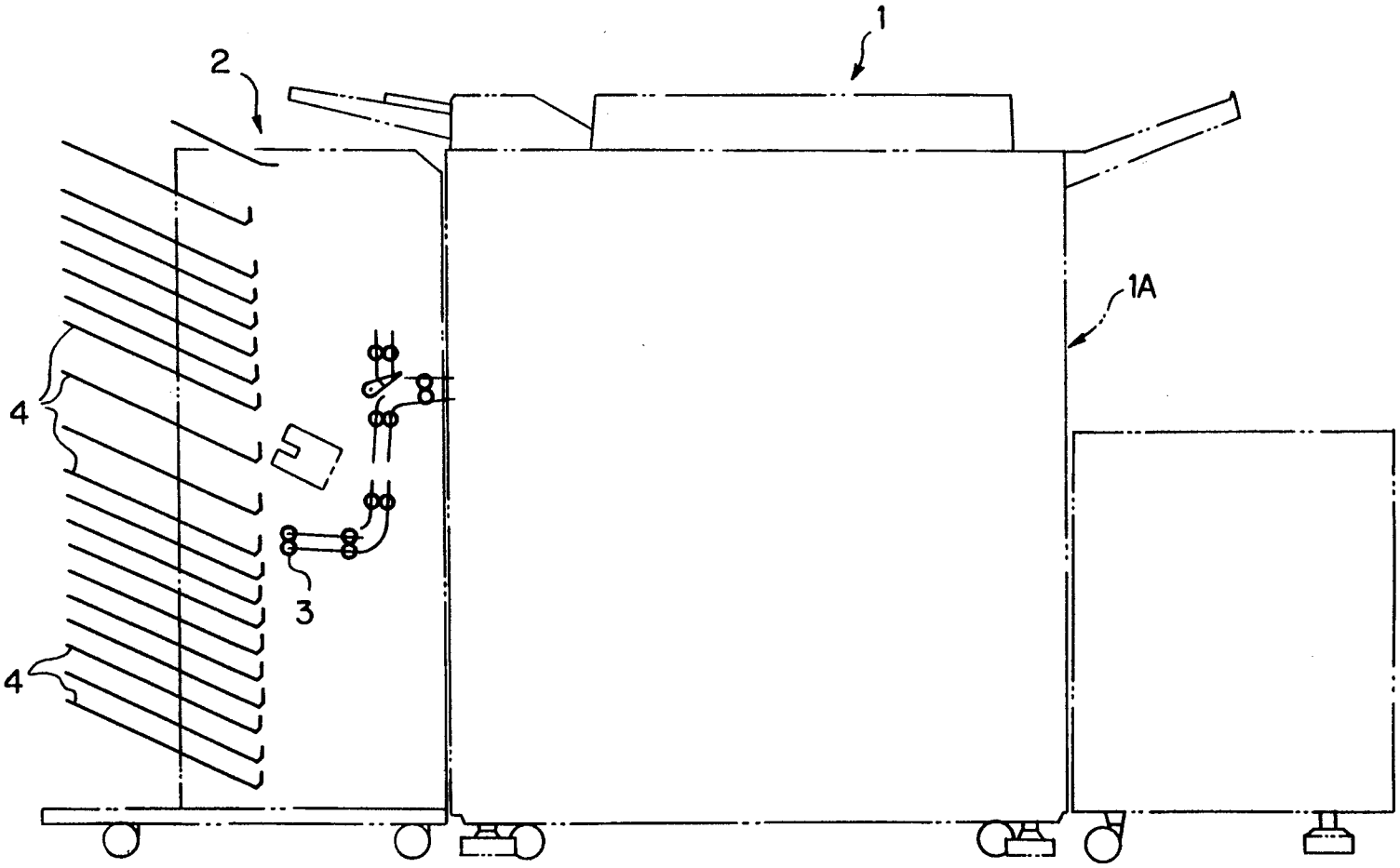
FIG. 1 is a view schematically showing the general construction of an image forming apparatus to which a finisher embodying the present invention is applied.

FIG. 1 shows the general construction of an image forming apparatus in the form of a copier to which the embodiment of the invention is applied. As shown, the copier, generally 1, has a copier body 1A and a sorter 2 operatively connected to a copy outlet section included in the copier body 1A. The sorter 2 has a copy transport path there inside which includes a sorting path where a transport roller 3 is located. A plurality of bins, or discharge trays, 4 are arranged one above another at the end of sorting path, so that copies may be driven into the consecutive bins 4 by the transport roller 3.

Figure 2:
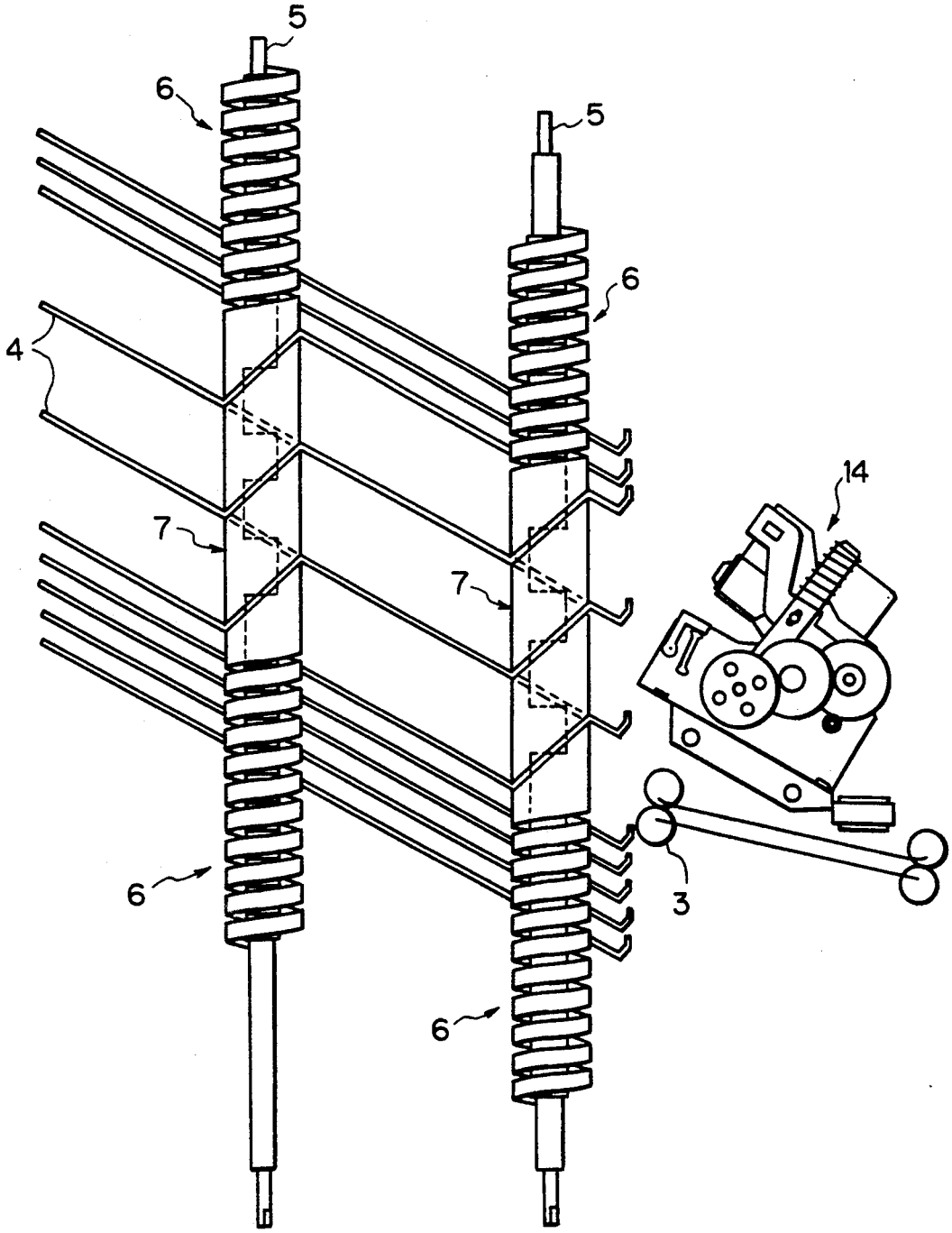
FIG. 2 is a fragmentary view of the embodiment implemented as a sorter.
Figure 3:
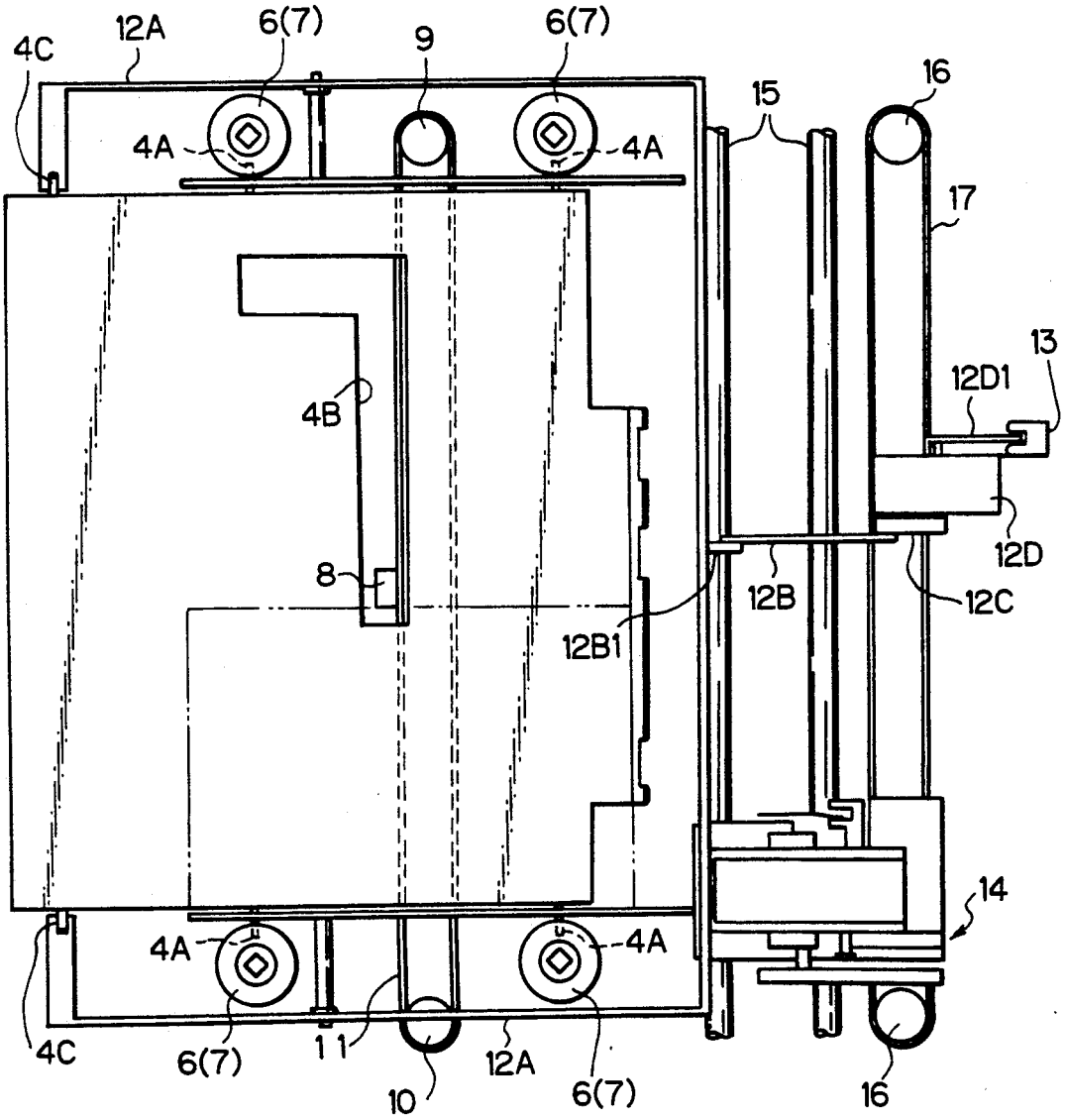
FIG. 3 is a fragmentary plan view of the embodiment.

As shown in FIG. 2, a pair of shafts 5 extend in the up-and-down direction within the sorter 2 and are spaced apart from each other in a direction parallel to the direction of copy discharge. Helical screws 6 and a helical cam 7 are affixed to each of the shafts 5 for moving the bins 4 up and down. Specifically, as shown in FIG. 3, two pairs of such shafts 5 each having the helical screws 6 and helical cam 7 are positioned at opposite sides of the sorter 2. Each bin 4 has pins 4A at both sides thereof which extend away from each other in the widthwise direction of a sheet S. The pins 4A of each bin 4 are received in the associated helical screws 6 and helical cams 7 to allow the bin 4 to move up and down in association with the rotation of the latter.

A sleeve, not shown, is fitted on part of each shaft 5 which has a rectangular cross section. The helical screws 6 and helical cam 7 are coupled over the rectangular part of the shaft 5 with the intermediary of the sleeve to be thereby prevented from rotating. The helical cam 7 having a comparatively great lead corresponds in axial position to a copy introducing mechanism and a stapling section, which will be described, while the helical screws 6 each having a comparatively small lead correspond to the other sections for transporting the bins 4. The lead of the helical screws 6 is selected such that the nearby bins 4 are spaced apart by a particular distance capable of straightening curled copy sheets driven into the bins 4.

As shown in FIG. 3, the edge of each bin 4 adjacent to the transport roller 3, i.e., positioned on the paper inlet side is notched except for an intermediate portion thereof in the widthwise direction. A slot 4B in the form of a letter L, as seen in a plan view, is formed through part of the bin 4 where paper sheets will be loaded. A jogger 8 is received in the slot 4B and is long enough to extend throughout all the bins 4. A pair of pulleys 9 and 10 are located at the bottom of the sorter 2 and at spaced positions in the widthwise direction of the sheet S. A belt 11 is passed over the pulleys 9 and 10 while the jogger 8 is affixed to the belt 11 to be movable in the widthwise direction of the sheet S. On abutting against one edge of the paper sheet S, the jogger 8 urges the other edge of the paper sheet S against one side wall wall 2A of the sorter to thereby neartly regulate the sheet S in a predetermined position. When one of the bins 4 is to be pulled out, as will be described, the jogger 8 is moved to part of the L-shaped slot 4B which is parallel to the direction in which the bin 4 is pulled out, as indicated by a dash-and-dots line in FIG. 4. In such a position, the jogger 8 is prevented from interfering with the movement of the bin 4 of interest.

Figure 4:
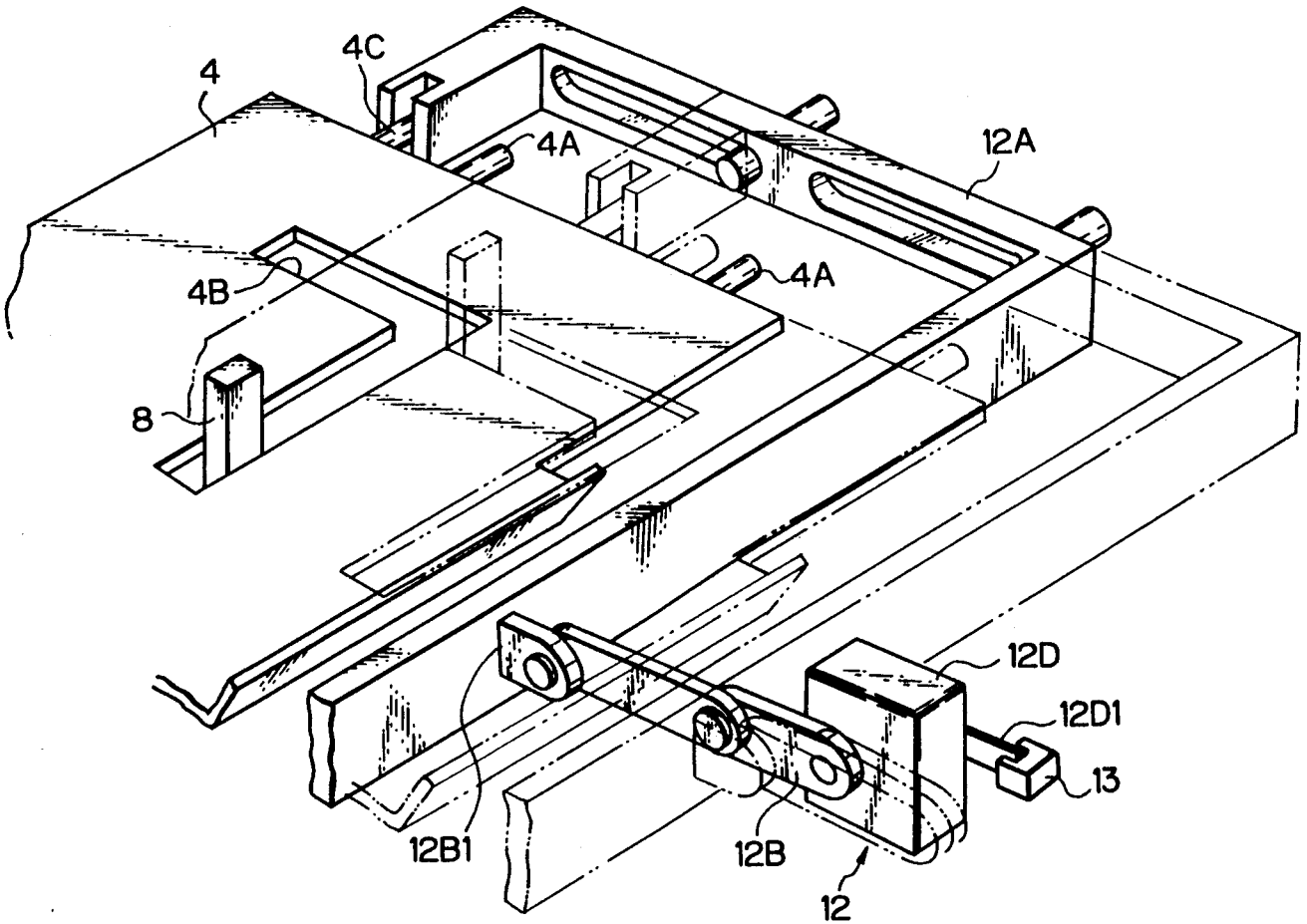
FIG. 4 is a perspective view of an engaging and disengaging mechanism included in the embodiment.

Each bin 4 has pins 4C in addition to the above-mentioned pins 4A received in the grooves of the helical screw 6 and helical cam 7. The pins 4C are engaged with a transmission lever 12A included in an engaging and disengaging mechanism 12. The engaging and disengaging mechanism 12 has an actuating lever 12B, a crank 12C, a drive motor 12D, and the transmission lever 12A. The transmission lever 12A is provided with a channel configuration capable of surrounding the edges of the bin 4 except for part of the latter which is located at the downstream side with respect to the intended direction of paper discharge, as seen in a plan view. The transmission lever 12A has engaging portions engaged with the pins 4C of each bin 4 and implemented as grooves parallel to the direction in which the bin 4 is movable up and down. As shown in FIG. 4, a bracket 12B1 is affixed to substantially the intermediate portion of part of the transmission lever 12A located on the paper inlet side. The transmission lever 12B is rotatably connected at one end thereof to the bracket 12B1 and at the other end to the crank 12C, transforming the rotary motion of the crank 12C to a parallel motion of the transmission lever 12A. The crank 12C is affixed to the output shaft of the motor, e.g., stepping motor 12D at one end and is rotatably connected to one end of the actuating lever 12B at the other end.

The motor 12D is capable of changing the phase thereof by 180 degrees in response to an output signal from a controller, not shown. Specifically, the free end of the crank 12C is movable between an ordinary position and a position opposite thereto. In the ordinary position which is indicated by a solid line in FIG. 3, it allows the bin 4 to move up and down. Such a position is detected when a sector 12D1 mounted on the output shaft of the motor 12D and a home position sensor 13 located on the locus of rotation of the sector 12D1 face each other. In this configuration, when the motor 12D is rotated away from an ordinary position thereof, it pulls out the crank 12C with the result that the bin 4 is moved toward the paper inlet side, i.e., to a position indicated by a dash-and-dots line in FIG. 4 due to the engagement of the pins 4C and the transmission lever 12A. The pin 4 which can be so moved toward the paper inlet side is guided by guide portions, which will be described, until the edge thereof on the paper inlet side reaches a stapler.

Figure 5:
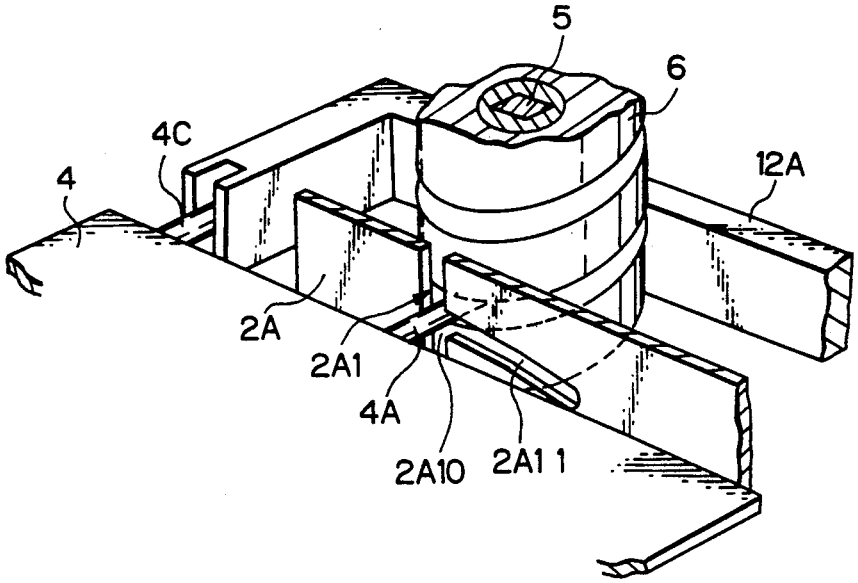
FIG. 5 is a fragmentary view representative of a relation between one side portion of a bin and a side wall also included in the embodiment.
Figure 6:
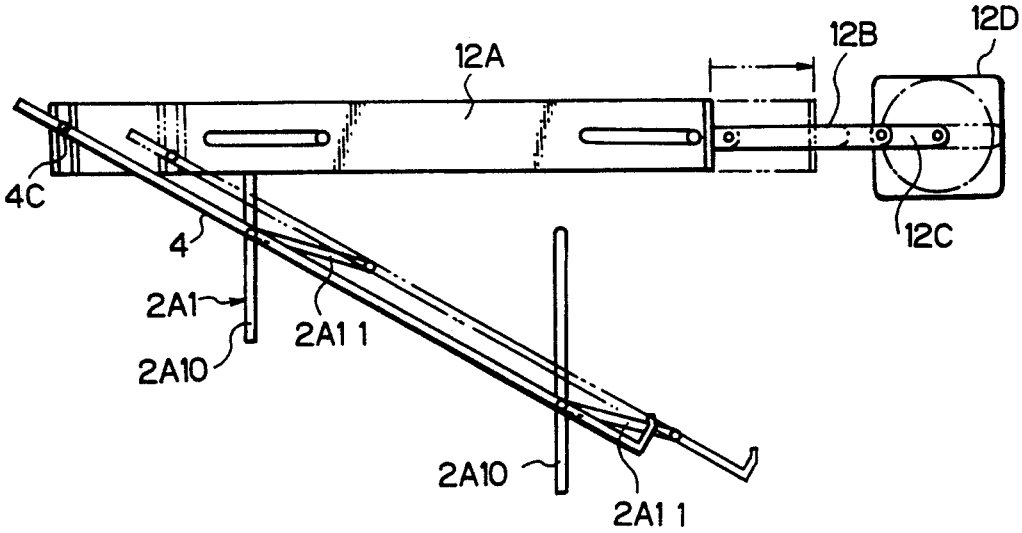
FIG. 6 is a side elevation indicative of a relation between the engaging and disengaging mechanism of FIG. 4 and the side wall.
Figure 7:
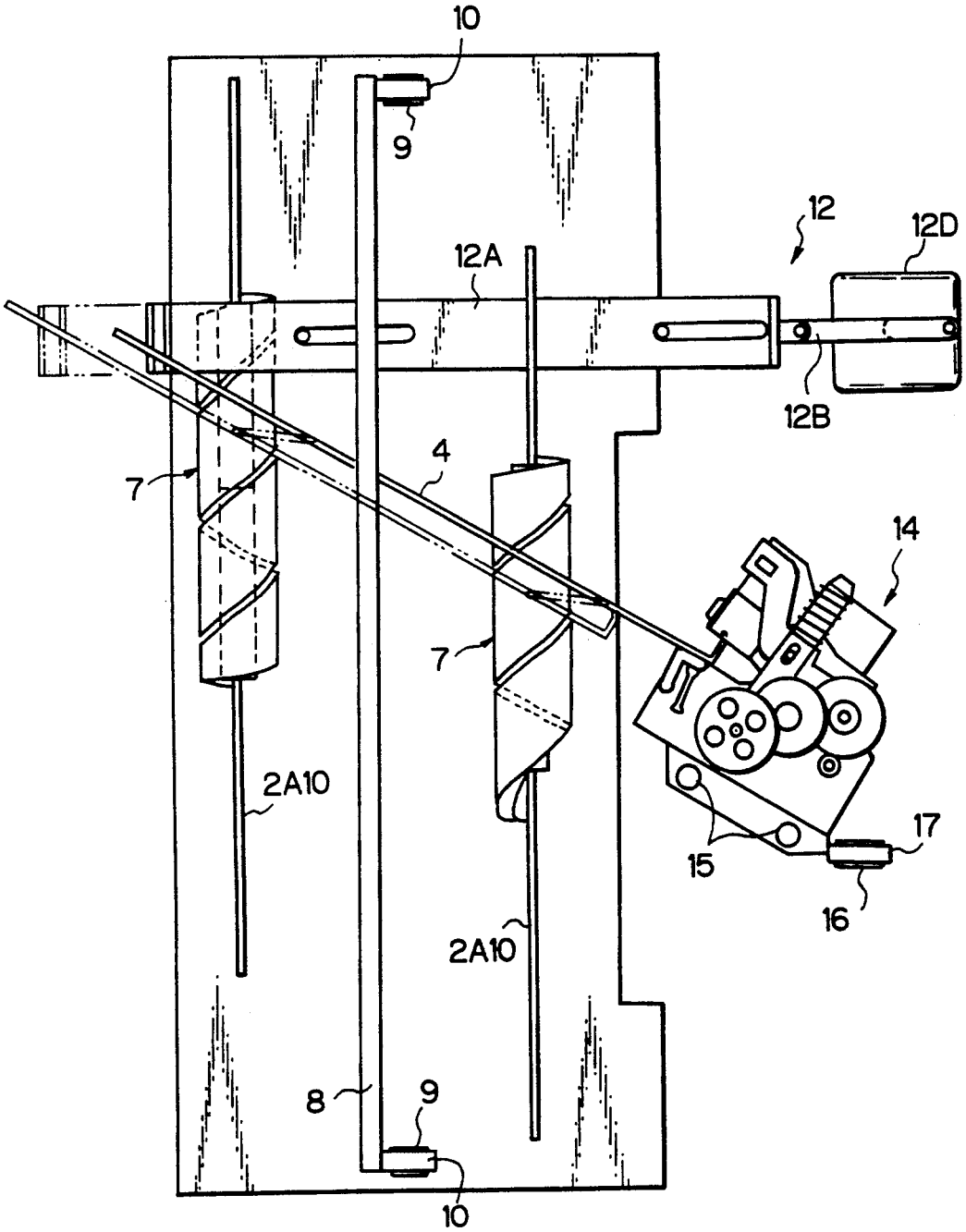
FIG. 7 is a side elevation demonstrating the operation of the embodiment.

The above-mentioned guide portions are formed in opposite side walls 2A of the sorter 2. Specifically, as shown in FIG. 5, each guide portion is implemented as a guide channel 2A1 receiving the pin 4A of the bin 4 therein. The guide channel 2A1 is made up of an up-down guide portion or vertical channel 2A10 extending in a direction parallel to the up-and-down direction of the bins 4, and an auxiliary guide portion 2A11 branching off the guide portion 2A10. The auxiliary guide portion 2A11 branches off the guide portion 2A10 at a position where it is capable of moving the bin 4 toward a stapler, which will be described; it extends from the branching position toward the paper inlet side substantially perpendicular to the up-and-down direction of the bins 4. The auxiliary guide portion 2A11 is inclined by an angle equal to the angle of the helical grooves of the helical screws 6 or approximate to the angle of the helical surfaces. As a result, the bin 4 is not noticeably changed in the angle of inclination during the upward or downward movement and is, therefore, pulled out without the orientation thereof noticeably changed. Assume that the engaging and disengaging mechanism 12 pulls out the pins 4C of the bins 4 toward the paper inlet side while the pins 4A of the bin 4 are located at a position where the auxiliary guide potions 2A11 of the guide channels 2A1 branch off the respective guide portions 2A10. Then, the pins 4C engaged with the transmission lever 12A are pulled with the result that the bin 4 is moved from the solid-line position shown in FIG. 6 until the pins 4A enters the associated auxiliary guide portions 2A11. In this condition, the edge of the bin 4 on the paper inlet side is protruded, as indicated by a dash-and-dots line in FIG. 6.

As shown in FIGS. 1 and 3, a stapler 14 is located at the position to which the edge of the bin 4 on the paper inlet side reaches when protruded as stated above. As shown in FIG. 3, the stapler 14 is implemented as an electrically driven stapler and has a body thereof slidably mounted on a pair of guide rods 15 extending in the widthwise direction of the paper sheet S. A belt 17 is passed over a pair of pulleys 16 which are spaced apart in a direction parallel to the direction in which the guide rods 15 extend. The body of the stapler 14 is affixed to part of the belt 17 to be movable in the widthwise direction of the paper sheet S. The stapler 14 has a home position where it faces one of the opposite notched edge portions of the bin 4 on the paper inlet side, and it is movable to the other notched edge portion. Hence, the stapler 14 is capable of stapling a stack of paper sheets S at two spaced positions in the widthwise direction of the latter.

The sorter having the above construction will be operated as follows. When a sort mode is selected, the helical screws 6 and helical cams of the sorter 2 are controllably driven by a signal sent from the controller, not shown, so as to lower the bins 4 to a home position where they are stacked one above another. As soon as a paper sheet, or copy, is driven out of the copier body 1A, the helical screws 6 and helicam cams 7 are rotated by one lead. At this instant, the helical cams 7 space apart the nearby bins 4 by a distance sufficient to receive the paper sheet. The helical screws 6 and helical cams 7 are continuously rotated to sequentially elevate the bins 4 until a predetermined number of paper sheets have been distributed to the bins 4. At this instant, the pins 4A of each bin 4 are guided by the associated guide portions 2A10 of the guide channels 2A1 while the pins 4C are guided by the engaging portions of the transmission lever 12A on reaching the engaging portions.

A plurality of spaced stapling positions are set up along the inlet edge of the paper sheets S, as follows. The motor 12D is energized when the pins 4C of one of the bins 4 reach the engaging portions of the transmission lever 12A, i.e., when the pins 4A reach the branching points of the associated guide channels 2A1. As a result, the transmission lever 12A is pulled out from the ordinary position toward the paper inlet side. Specifically, the transmission lever 12A is pulled toward the paper inlet side via the crank 12C and actuating lever 12B, as indicated by a solid line in FIG. 7. Then, the edge of the bin 4 opposite to the edge on the paper inlet side is pressed and, therefore, the pins 4A are each transferred to the auxiliary guide portion 2A11 of the associated guide channels 2A1. Consequently, the bin 4 is moved in a direction perpendicular to the up-and-down direction without the position thereof indicated by the dash-and-dots line in FIG. 7, particularly the angle of inclination thereof, changed little. Finally, the bin 4 is brought to the solid-line position shown in FIG. 7 where the edge thereof on the paper inlet side is aligned with the stapler 14. In this condition, the stapler 14 staples the stack of paper sheets S while moving between the two positions in the widthwise direction of the bin 14.

From the efficiency standpoint, it is desirable to staple all the stacks of paper sheets at one position in the widthwise direction and then staple them at the other position. If desired, however, the stacks of paper sheets may be stapled at two positions one after another.

Of course, the stapler 14 may be located only at a predetermined position for stapling each stack of paper sheets at one end in the widthwise direction thereof.

It should be noted that the embodiment is capable of stapling a stack of paper sheets at any desired number of positions other than the two positions shown an described.

While the foregoing description has concentrated on a finisher in the form of a stapler, the embodiment is practicable even with other finishers including a stamping unit and a punching unit.

The illustrative embodiment is capable of setting up a plurality of stapling positions in the widthwise direction of a paper stack without interfering with the bins 4 other than one to undergo a stapling operation. This prevents the distance between the other bins from being effected and, therefore, preserves the function of paper straightening function implemented by such a distance.

In summary, it will be seen that the present invention provides a finisher which includes an engaging and disengaging mechanism for moving a bin in a direction perpendicular to the up-and-down direction and, therefore, allows the bin to be pulled out in such a direction. This is successful in extending the motion of, for example, a stapling unit in the widthwise direction of the finisher and, therefore, in stapling a stack of paper sheets at a plurality of spaced positions in the widthwise direction of the stack.

Guide portions for guiding the up-and-down movement of the bins each has a branch or auxiliary guide portion. Since the auxiliary guide portions are inclined by the same or substantially the same angle as the helical surfaces, each bin can be smoothly moved in the above-stated direction without having the position thereof, particularly the inclination thereof, sharply changed.

An engaging and disengaging mechanism includes engaging portions extending in parallel to the guide portions. When the bins are not expected to move toward the paper inlet side, the engaging portions surely prevent the former from moving toward the latter.

Moreover, the bin is allowed to move into the auxiliary guide portions only when a stapling or similar finishing operation is needed. Hence, the control over the movement of the bins does not have to be effected independently of the sorting operation and is, therefore, simplified.

Various modifications will become possible for those skilled in the art after receiving the teachings of the present disclosure without departing from the scope thereof.

What is claimed is:

1. In a finisher in which a plurality of bins in the form of trays each has part of opposite ends thereof in a widthwise direction of a paper sheet engaged with grooves of rotatable helical screws and helical cams and each is moved in an up-and-down direction for sorting paper sheets, said bins each has an engaging portion at each of opposite ends thereof in said widthwise direction independently of said part engaged with said grooves of said helical screws and said helical cams, an engaging and disengaging mechanism being connected to said engaging portions for moving said bin in a direction perpendicular to said up-and-down direction.

2. A finisher as claimed in claim 1, wherein auxiliary guide portions each branches off one of opposite guide portions which guide said bins in the up-and-down direction, whereby said bins each is movable in the direction perpendicular to said up-and-down direction along said auxiliary guide portions.

3. A finisher as claimed in claim 2, wherein a stapling unit is located in a position which said bins each reaches when moved in the direction perpendicular to the up-and-down direction.

4. A finisher as claimed in claim 3, wherein said stapling unit is movable in the widthwise direction of a paper sheet.

5. A finisher as claimed in claim 2, wherein said auxiliary guide portions extend toward an inlet side where paper sheets are introduced in said finisher.

6. A finisher as claimed in claim 2, wherein said auxiliary guide portions are each inclined by the same or substantially the same angle as helical surfaces of said helical screws and said helical cams.

* * * * *